US006419121B1

(12) United States Patent
Gutierrez et al.

(10) Patent No.: US 6,419,121 B1
(45) Date of Patent: Jul. 16, 2002

(54) DISPENSING DEVICE AND METHOD FOR RAPIDLY HEATING AND DELIVERING A FLOWABLE PRODUCT

(75) Inventors: Jose Antonio Gutierrez, Kent; Balakrishna Reddy, Ridgefield; Robert Greene, Bridgewater, all of CT (US)

(73) Assignee: Nestec, S.A., Vevey (CH)

( * ) Notice: Subject to any disclaimer, the term of this patent is extended or adjusted under 35 U.S.C. 154(b) by 0 days.

(21) Appl. No.: 09/788,652

(22) Filed: Feb. 20, 2001

(51) Int. Cl.[7] ..... B67D 5/62
(52) U.S. Cl. ..... 222/146.5
(58) Field of Search ..... 222/94, 95, 105, 222/146.1, 146.5

(56) References Cited

U.S. PATENT DOCUMENTS

| | | | | |
|---|---|---|---|---|
| 3,173,579 A | | 3/1965 | Curie et al. | 222/105 |
| 3,212,681 A | | 10/1965 | Weikert | 222/183 |
| 3,297,206 A | | 1/1967 | Scholle | 222/105 |
| 3,520,451 A | * | 7/1970 | Ashizawa | 222/148 |
| 4,094,446 A | | 6/1978 | Brutsman | 222/146 HE |
| 4,141,474 A | | 2/1979 | Nilson | 222/493 |
| 4,544,085 A | | 10/1985 | Frazer | 222/146.4 |
| 4,651,898 A | | 3/1987 | Bell | 222/129 |
| 4,717,047 A | | 1/1988 | van Overbruggen et al. | 222/207 |
| 4,796,788 A | | 1/1989 | Bond | 222/94 |
| 4,941,597 A | | 7/1990 | Lopez et al. | 222/146.5 |
| 5,000,351 A | | 3/1991 | Rudick | 222/105 |
| 5,040,700 A | | 8/1991 | Compton | 222/146.5 |
| 5,102,015 A | | 4/1992 | Barnard et al. | 222/135 |
| 5,142,610 A | | 8/1992 | Augustine et al. | 392/442 |
| 5,249,706 A | | 10/1993 | Szabo | 222/20 |
| 5,349,825 A | | 9/1994 | Duke et al. | 62/69 |
| 5,353,963 A | | 10/1994 | Gorski et al. | 222/129.1 |
| 5,366,308 A | | 11/1994 | Crispino | 401/1 |
| 5,803,317 A | * | 9/1998 | Wheeler | 222/146.5 |
| 6,003,733 A | * | 12/1999 | Wheeler | 222/146.5 |
| 6,016,935 A | | 1/2000 | Huegerich et al. | 222/146.1 |
| 6,056,157 A | | 5/2000 | Gehl et al. | 222/94 |

* cited by examiner

*Primary Examiner*—William C. Doerrler
*Assistant Examiner*—Thach H. Bui
(74) *Attorney, Agent, or Firm*—Winston & Strawn

(57) ABSTRACT

The invention relates to a method and a dispensing device for rapidly and efficiently heating/cooling a flowable food product whereby removable cassettes are provided for receiving a pouch containing food; the cassettes comprising pairs of opposed thermal conductive surfaces wherein the surfaces delimit together a limited spacing adapted to contact a pouch and means for applying heat to said at least pair of cassettes.

26 Claims, 12 Drawing Sheets

DISPENSING DEVICE AND METHOD FOR RAPIDLY HEATING AND DELIVERING A FLOWABLE PRODUCT

FIELD OF THE INVENTION

The invention relates to a device and method for dispensing flowable materials from flexible containers and, more particularly, to a device and method for more accurately, uniformly and rapidly heating/cooling a food product and for delivering the food product at a desired controlled temperature from a flexible container.

BACKGROUND OF THE INVENTION

Heated or refrigerated dispensers for delivering liquid or semi-liquid food products are commonly used in foodservice restaurants, catering, convenience stores and other commercial or public food establishments. The known dispensers are usually adapted for receiving food bags in a housing and to deliver the food by using pumps and/or gravity forces to a dispensing area.

Food product, such as cheese sauces and the like, usually requires to be served at warm temperature to adapt to culinary habits and/or to improve the digestion of fat. Other food products are adapted to be stored at ambient such as UHT cream, sterilized salad dressing or pudding but request to be served at a refrigerated state. These food products are also usually low acid food which may be easily subjected to bacterial spoilage when opened, whereby heating or cooling permits to keep the food in safer bacteriological conditions. The products usually need to be stored in aseptically hermetic flexible packages such as pouches, which are opened at the time the product is dispensed. The problem is that the pouches are usually of relatively large size, in general of several kilograms, thus requiring a relatively long time before obtaining a controlled hot/cool temperature acceptable for serving.

One disadvantage of having a long heat-up/cooling-down time is that a fully warm/cool food bag may not be rapidly available when the demand for food exceeds the warming/cooling operation time for the new bag. Another disadvantage is when the bag is opened before the product reaches a sufficiently safe temperature level, i.e., about 60° C. in the case of hot product or below 4–6° C. for refrigerated products, the risk of bacterial contamination or spoilage seriously increases.

For instance, the American NSF standards require that potential hazardous food products having a pH level of 4.6 or less to be rethermalized; i.e., heated from refrigerated or ambient state to an elevated temperature of not less than 140° F., must be capable of heating the food product to that temperature within four hours. For example, by using existing commercial equipment, the average heat-up time for large size pouches is of more than 2 hours, most often of more than 5 hours and sometimes of more than 10 hours before the center part of the pouch can reach an acceptable warm temperature of 60° C. from ambient.

In order to meet with the regulations, prior solutions consisted in pre-warming the bag in a hot water bath or in microwave oven, then, transferring the preheated bag to the dispensing unit where the bag remains temperature controlled. However, this is not satisfactory as it requires to have an additional piece of equipment for heating available. A water bath is usually cumbursome and requires a long time to warm up. Microwave heating also suffers from non-homogeneous heating problems with formation of cold and hot spots in the food. It also requires manipulation and surveillance by the foodservice operators to transfer the food pouch from the microwave unit to the holding unit. Finally, it is required to invest in microwave ovens of sufficiently large capacity and of wide radiation fields to accommodate large size pouches.

Similarly, for sterilized food products that require to be served refrigerated, it is frequent that the foodservice operator cannot count on a refrigerating room for pre-cooling the food due to lack of space or for economical reasons.

U.S. Pat. No. 5,803,317 to Wheeler relates to a heated dispensing apparatus for dispensing products at elevated temperature which allows packaging of the product in a container, such as a flexible bag, with a discharge tube extending therefrom. The dispenser includes a receptacle with an outlet opening in the lower portion thereof and a pump adjacent to the outlet opening. A heater is provided for heating the food bag in the receptacle and the discharge tube passing through the pump and maintaining both the bag and the tube at a desired elevated temperature. The receptacle is arranged to accomodate the reception of so-called "bag-in-box" type of package as illustrated in FIG. 1 of the patent. This type of package are disclosed in U.S. Pat. Nos. 3,173,579 and 4,796,788. The box portion of the "bag-in-box" type package is not required for use with the dispensing device. The bag itself is usually a bulky flexible bag with a fitment protruding on one side of the bag. The bag is arranged in the receptacle so that only the side with the fitment is positioned adjacent a sloped heated bottom wall of the receptacle with the fitment of the bag passing through the outlet opening which ends or extends by a discharge tube. Due to the position of the bag in the receptacle, the thermal transfer from the receptacle to the bag remains relatively poor, thereby leading to excessive heat-up time when cold and large size bags are loaded for rethermalization. Furthermore, the heating pattern cannot be obtained uniformly within the product and a heat gradient is likely to form with the warmer side in contact with the receptacle and the colder side opposite. As a result, the food product may experience browning and darker spots, which consequently affect the quality and shorten the shelf life of the food product.

U.S. Pat. No 6,003,733 to wheeler notices the heating of the food product by pure conduction transfer as taught by former U.S. Pat. No. 5,803,317 does not always provide an optimal uniform heating and may make the internal and external receptacle surfaces extremely hot thereby increasing the difficulty of handling the dispenser. Therefore, it proposes to replace the conduction means by convection heating means using a rear heating assembly to continuously circulate heated air into the internal cavity around the receptacle for the bag to maintain the food product at elevated temperature. However, the time necessary for heating a large capacity bag from ambient to a temperature of serving remains a significant problem with such a device as well. A heating gradient is also likely to occur as the bag presents both heat sink zones and air contact zones of large surfaces due both to the type of bag and to the manner the bag rests in the receptacle.

U.S. Pat. No. 6,016,935 relates to a viscous food dispensing and heating/cooling assembly which is adapted to receive large food reservoirs of the "bag-in-box" type in a manner similar to the previous patent references; the improvement consisting in a specific air flow circulation to heat both the reservoir and the discharge tube.

U.S. Pat. 6,056,157 to Gehl proposed a dispensing unit with a heated hopper which is sized to receive two superposed "bag-in-box" type bags; a lower dispensing food bag resting flat along a bottom sloped wall with its fitment oriented horizontally and operatively connected to a dispensing unit and a second bag placed on top of the lower bag to serve as a weight for promoting gravity flow from the lower dispensing food bag and to precondition the second food bag. Due to the relatively thick material mass created by the superposition of two bulky bags, the time for heating the bag is very long. Similarly, more thermal energy is required for constantly maintaining the bags at warm temperature. The food will also experience a heat gradient with quick apparition of brown and dark spots. In this prior art device, a preheating compartment may be provided in the hopper to preheat a food bag more rapidly. The dispensing bag can then spread out in the hopper below the preheating compartment for dispensing purpose. The manner the bag spreads out in the hopper is similar to the previously discussed patents. Such heating and dispensing configuration has several shortcomings. Firstly, the heating of the dispensing bag is not optimized due to the spreading out of the bag along the sloped bottom wall and therefore is energy consuming. Secondly, the evacuation of food from the dispensing food bag is relatively poor despite the provision of the sloped geometry for supporting the dispensing bag. Thirdly, the preheating compartment is likely to provide a reduction of the heat-up time but not in a magnitude that can really be considered as a major advantage of the device. Fourthly, the hopper and its preheating compartment is configured to render the positioning and removal of the dispensing bag relatively uneasy in hot conditions because the preheating compartment partly obstructs the passage when the operator needs to have access to the dispensing bag. Fifthly, handling of hot bags in the device may create risks of bums for the operator, in particular when touching hot parts of the hopper.

German company Herman Roelofsen GmbH manufactures food dispensing units comprising a relatively wide box-shaped aluminum container adapted to receive a flexible food bag. The bag is loosely housed within the container and a bar inserted in two slots of the container hangs up the bag to avoid collapsing of the bag within the container. The container fits within a heating metal compartment of the unit which is heated by flexible heating devices. Due to heat loss in the transitions and air gaps from the heaters to the food, the dispensing unit has poor heating performance on large size bags with an heat-up time of more than 10 hours from ambient state for cheese sauce bags. Therefore, microwave preheating of the bag is required before the bag can be installed in the dispensing unit.

SUMMARY OF THE INVENTION:

Therefore, one object of the invention is to provide a dispensing device that confers an improved heating/cooling output over the existing devices of the prior art, in particular, reduces the heat-up/cooling-down time significantly and is easy to hold the product at the desired controlled temperature while not being more energy consuming than existing equipment.

Another object of the invention is to provide a dispensing device, whereby uniform heating/cooling is promoted within the bag or pouch with no significant heat/cooling gradient, therefore, preventing from quality and safety issues and increasing the shelf life of the product when installed in the unit.

Another object of the invention is to ensure more continuity in delivering food product at a desirable controlled temperature; i.e., heated or refrigerated temperature, and convenience for the foodservice operator.

Another object of the invention is to provide a system which avoids having to control the temperature of the food in a separate unit such as to preheat/precool the food in a microwave oven/refrigerator.

Another object of the invention is to provide a dispensing configuration, whereby the product evacuation is improved with a minimum of non-dispensable residue left in the bag or pouch.

Another object of the invention is to improve the handling of the food container's from an operator's point of view while minimizing the operator's manipulation and minimizing hazards such as risks of bums with the bag and/or hot parts of the device.

Therefore, the invention relates to a food dispensing device having an enhanced capacity for controlling the temperature of a flowable food product comprising:

a housing defining an interior cavity;

a first pair of opposed thermal conductive surfaces delimiting a spacing therebetween adapted for receiving a first pouch having two extensive walls; said thermal conductive surfaces being substantially oriented within the housing so that the pouch substantially remains in a standing position while the thermal conductive surfaces being arranged to intimately contact said extensive walls of the pouch;

means for controlling temperature of said first pair of opposed thermal conductive surfaces;

means adapted to operatively connect to the first pouch for selectively delivering portions of food from the first pouch.

In a preferred embodiment, the dispensing device further comprises at least a second pair of opposed thermal conductive surfaces delimiting a spacing therebetween adapted for receiving a second pouch having two extensive walls; said thermal conductive surfaces being substantially oriented within the housing so that the pouch substantially remains in a standing position while the thermal conductive surfaces being arranged to intimately contact said walls of the pouch.

Preferably, the spacing for receiving the pouch of the thermal conductive surfaces of the first pair and, even more preferably of the first and second pairs, is equal to or less than 40 mm, even preferably of about 35 mm or less. A limited spacing as defined allows the food product to spread along the heating surfaces regardless of the pouch capacity while eliminating the areas of higher thermal inertia in the food product. Such spacing has proved both to promote a rapid heat-up of the pouches and to require less energy for constantly maintaining the pouches at an elevated temperature. Therefore, it also contributes to more uniformly and accurately control the temperature of the food product with reduction of heat gradients. Consequently, it is made possible to eliminate the hot spots which normally create local browning of the food, thereby affecting its quality and shelf life. The temperature of the food product can also be maintained substantially constant over time, thereby similarly ensuring a longer shelf life. Although not expressly limited to large capacity pouches, the invention promotes a more efficient, accurate and rapid heating of the food product; i.e., in less than 2 hours from ambient, when the pouches contains more than 2.0 Kg, and even more than 2.5 Kg of food product.

Preferably, the at least first and second pairs of opposed thermal conductive surfaces are parts of removable cassettes which may further comprise a bottom surface and an outlet opening, preferably arranged in the bottom surface, to allow a discharge tube of the flexible pouch to pass therethrough. The cassettes are removable from the housing, thereby facilitating the exchange of cassettes for replacement of the pouch by a new pouch and/or to change the relative location of the cassettes within the housing so that one cassette which was held in a preheating mode may be installed in a dispensing mode and inversely.

In a preferred mode, at least two identical cassettes are provided within the housing to offer the possibility to have a first dispensing cassette and a second preheating cassette; the dispensing cassette being removable to be replaced by the preheated cassette at any required time after the food in the preheated cassette has reached an acceptable elevated temperature within the housing. Preferably, the first cassette is positioned in the housing in a position adapted to a dispensing mode; e.g., whereby the outlet opening of the cassette may preferably substantially aligned with the valve means. The first cassette is also constantly maintained at the right elevated temperature while dispensing of the food. Preferably, the second cassette is positioned in the housing in a preheating mode where the outlet opening of the cassette is substantially offset with respect to the valve means. Still in a preferred mode, the first and second cassettes are configured in parallel in the housing to permit one cassette to be replaced by the other more easily. The cassettes may preferably be removable from the housing by sliding motion of the cassette(s) in a primary direction after opening of the housing. It is meant that the same modularity approach can be applied for cooling of the pouch; i.e., using dispensing refrigerated cassette(s) and pre-refrigerating cassette(s) which can be exchanged one by the other to ensure a continuity in the supply of refrigerated product and, therefore, more convenience to the foodservice operator.

For food that needs to be served warm, the means for controlling the temperature of the thermal conductive surfaces may preferably be heating means to heat the product in the pouches. Importantly, heating is provided to the thermal conductive surfaces so that the thermal conductive surfaces serve as primary conductive heaters for the pouch. For that, the heating means may be resistive heating elements directly coupled to said opposed thermal conductive surfaces and/or air forced convection means adapted to provide hot air substantially surrounding the thermal conductive surfaces.

In an embodiment, the thermal conductive surfaces may comprise at least a first and second resistive heating sets which are capable of being selectively operated to provide at least two different power modes. In this way, it is made possible to accomplish a two-mode heating of the food product; i.e., a first heat-up mode whereby the food can heat up fastly by receiving a higher heating power and a second holding mode, whereby the food can be maintained at the desired elevated temperature by receiving a comparatively lower heating power. The two modes may be carried out by selectively operating the first and second resistive sets using suitable controlling and thermostatic means.

The heating means may also pass through the valve means to maintain the product at elevated temperature in the tubing of the pouch as already taught in U.S. Pat. No. 5,803,317. As taking part of the uniform and rapid heating capacity of the device of the invention, the convection means preferably comprises a series of flow paths which distribute hot air along the thermal conductive surfaces. Of course, it may be possible to combine resistive heating means and convection means in the same device.

In another aspect, the invention relates to a dispensing device for dispensing flowable food product comprising:

a housing defining an interior cavity;

at least one pair of removable identical cassettes within the housing; each being adapted for receiving a pouch containing food; said cassettes comprising pairs of opposed thermal conductive surfaces wherein the surfaces delimit together a spacing adapted to receive a pouch;

means for controlling the temperature of said at least pair of cassettes; wherein the cassettes are interchangeable.

Another aspect of the invention relates to a dispensing device for rapidly and efficiently heating/cooling a flowable food product whereby removable cassettes are provided for receiving a pouch containing food; the cassettes comprising pairs of opposed thermal conductive surfaces wherein the surfaces delimit together a spacing adapted to contact a pouch and means for controlling the temperature of said at least pair of cassettes.

Another aspect of the invention relates to a method for rapidly heating/cooling and delivering a flowable food comprising:

providing a pouch comprising two extensive walls connected together by a plurality of peripheral edge portions to form a closed interior for the food of relatively narrow profile; and a fitment to deliver the flow of food through an outlet; said fitment being sealed across one edge portion of the pouch;

positioning said pouch between two opposed vertically oriented thermal conductive surfaces delimiting a spacing therebetween adapted for receiving the pouch with the extensive walls intimately contacting the thermal conductive surfaces;

controlling temperature of the food contained in the pouch by conduction transfer from the two thermal conductive surfaces to the pouch;

providing valve means to selectively control the flow of food from the pouch.

In another aspect, the invention relates to a method for ensuring a steady supplying in warm food product within a dispensing device comprising:

providing a pair of cassettes containing food within a container; said cassettes being interchangeable within the dispensing device;

providing heat to each of said cassettes to warm the food product;

dispensing food from one of said heated cassettes while holding the other cassette warm.

BRIEF DESCRIPTION OF THE DRAWINGS:

The details of the preferred embodiments of the invention are illustrated in the appended drawings figures, wherein.

Figure 1:
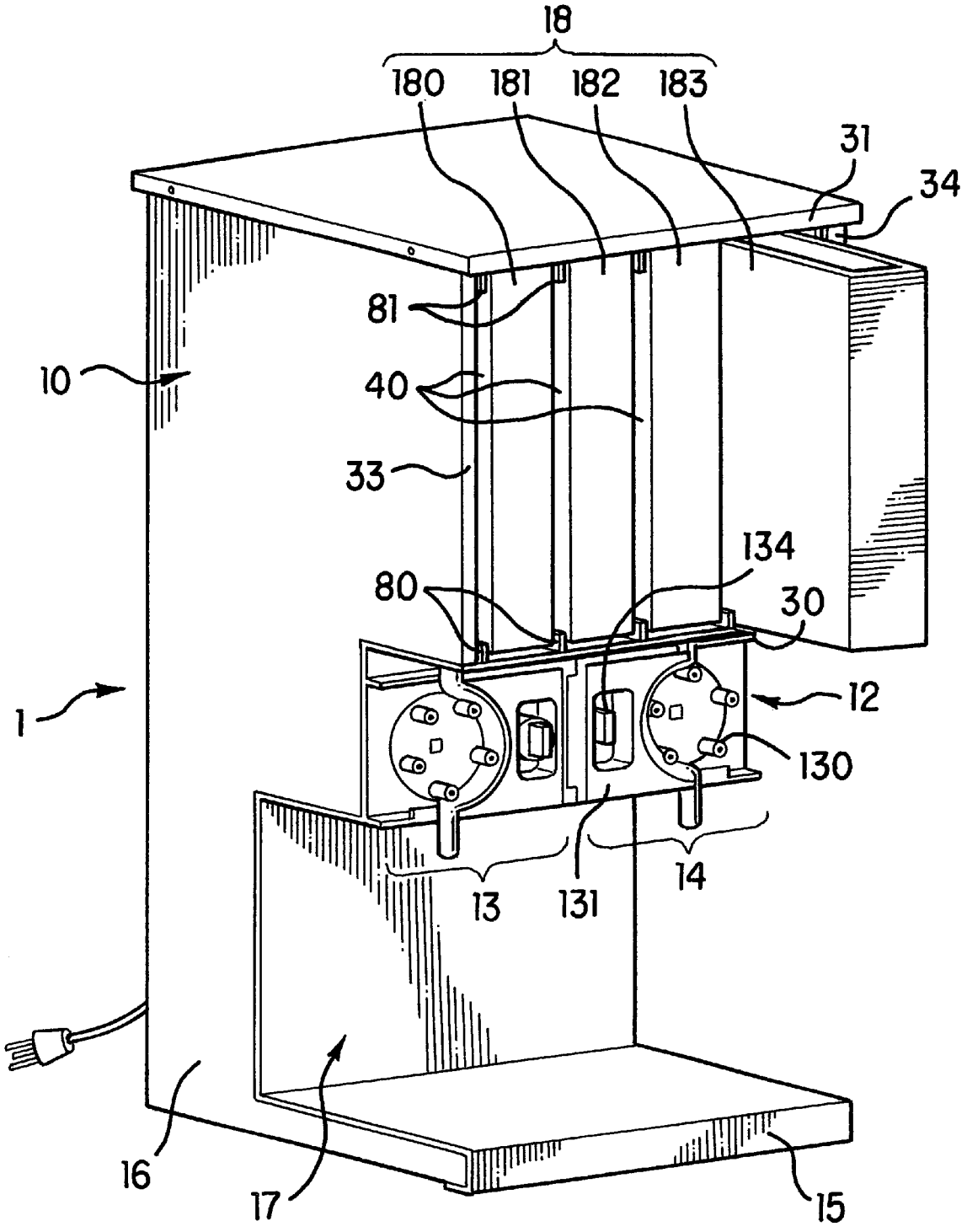
FIG. 1 relates to a perspective view of the heated dispensing device of the present invention with its front panel being removed.

DETAILED DESCRIPTION OF THE PREFERRED EMBODIMENTS:

Referring generally to FIGS. 1 to 4, it may be seen that the dispenser is shown generally by the character numeral 1 and includes a main housing 10 demarcating a interior cavity, a secondary housing 12 for selective dispensing valve means 13, 14, a pedestal 15 and a stanchion portion 16 extending vertically from near the rear of the pedestal so as to leave a front receiving cavity 17 allowing a recipient to be positioned to receive the food product from the device. In FIG. 1, the front panel 19 of FIG. 2 has been omitted to better show the interior configuration within the housing 10.

Figure 2:
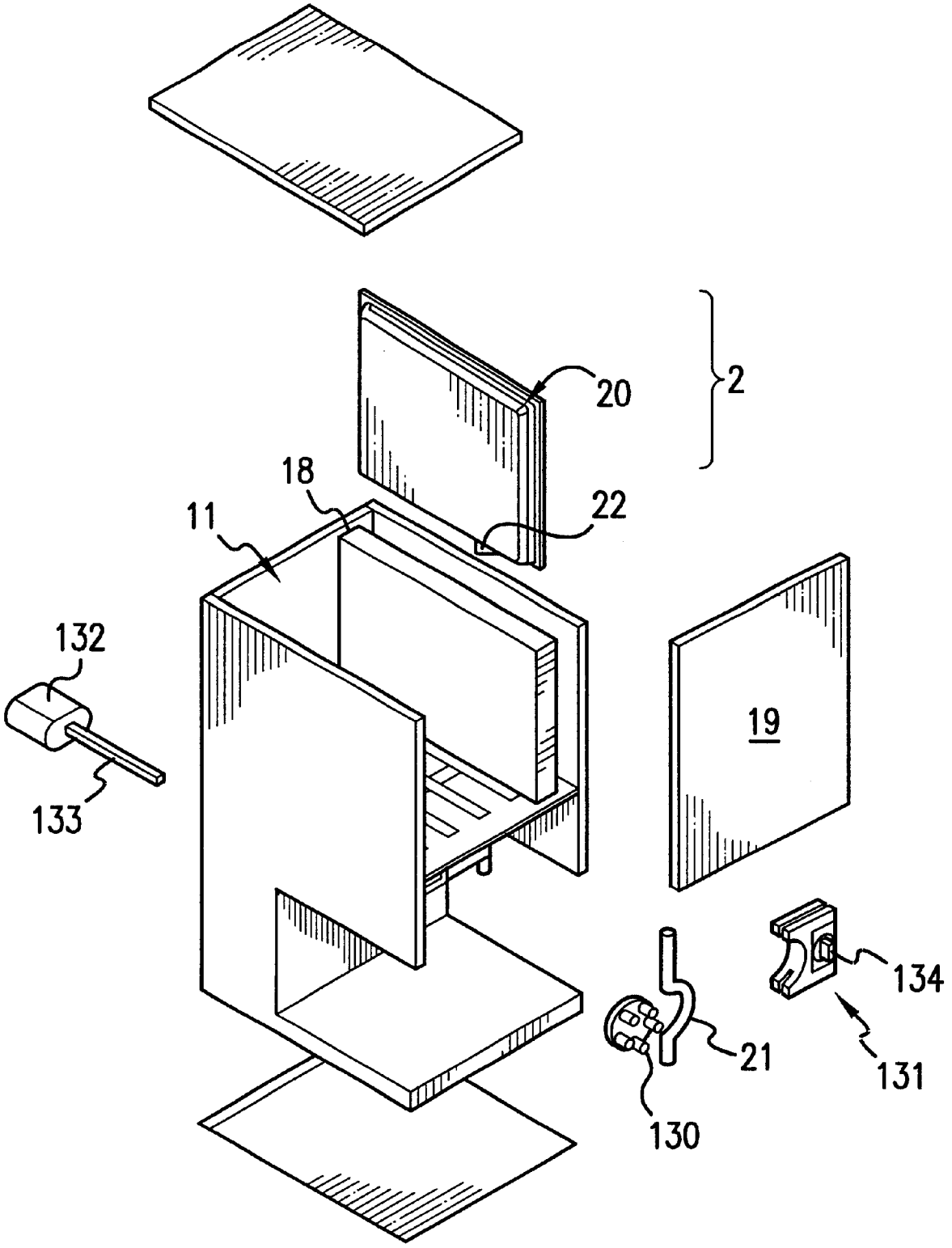
FIG. 2 is an exploded perspective view of the dispensing device of FIG. 1 with a pouch of the invention.

The valve means 13, 14 may encompass various manual or mechanical actuated valves or pumping systems. Examples of very simple manual valves are "cloth-pin" style valves. However, when the viscosity of the food product is such that the product cannot be dispensed by gravity forces only and/or when an accurate flow control of the food to dispense matters, it is required that a pump assembly, preferably a volumetric positive displacement pump assembly such as a peristaltic pump be used, as shown in the drawings. FIG. 2 further shows a peristaltic pump assembly which comprises a rotor 130 with pinch rollers, a frame or stator 131 capable of assembling with the rotor 130 via a cam mechanism 134, well known in the art, to form a passage for a dispensing tube 21 attached to the fitment 22 of the main body 20 of a food pouch 2. A motor assembly 132 is provided at the rear of the housing which includes a drive shaft 133 which passes through the housing and is coupled to the center of the rotor 130 for driving the rotor in rotation upon actuation of the motor by an electrical signal. The motor may be either a selectable speed continuous rotating motor, a stepping motor, or any other device producing a determined angular velocity of the drive shaft 133 or a controllable amount of angular rotation of the drive shaft.

Figure 4:
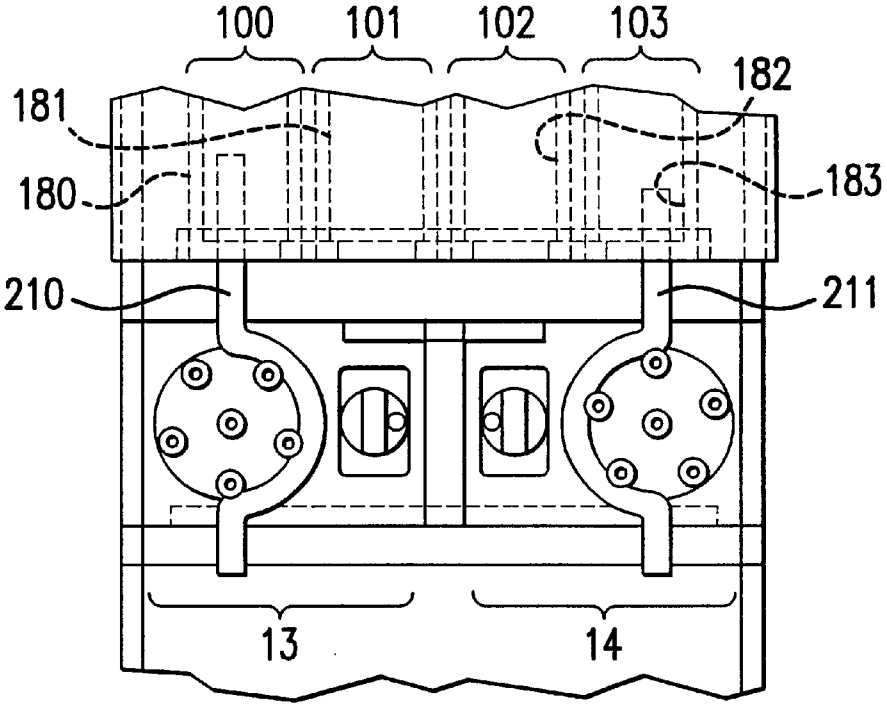
FIG. 4 is an enlarged view of FIG. 3.
Figure 3:
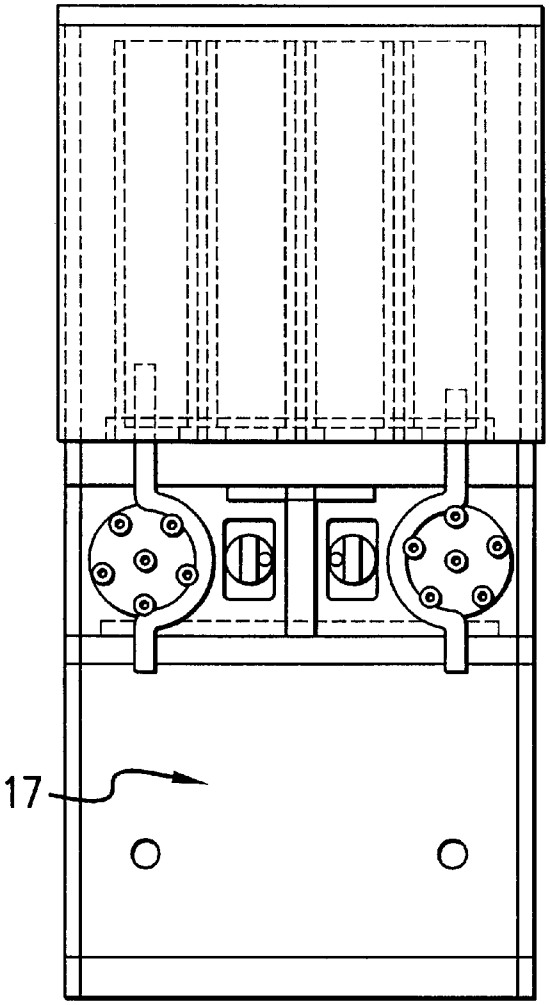
FIG. 3 is a front elevation view of the dispensing device of FIG. 1.

In a preferred aspect of the invention, the housing comprises a plurality of individual narrowly profiled cassettes 18 which are vertically arranged within the housing to form a series of cassettes 180, 181, 182, 183 arranged in parallel within the housing. Each cassette is adapted to accommodate a complementarily profiled food pouch or bag 2 as shown in FIG. 2. The number of cassettes within the housing is not limited and depends upon the capacity of the device and/or the types of food product to be dispensed. However, the number of cassettes of the device should preferably be a multiple of 2 as it is envisioned that the device comprises cassettes which are either in a dispensing mode or in a preheating mode within the housing 10. More specifically, as shown in FIG. 4, the cassettes 180, 183 which are in a dispensing mode are operatively connected to respective pumping assemblies 13, 14 with the dispensing tubes 210, 211 of the respective pouches being in an engaging configuration in the pumping assemblies 13, 14. As for the remaining cassettes 181, 182, there are cassettes resting in a preheating mode; i.e., without having the tubes of their respective pouches connected to the pumping assemblies. Once the cassettes 180 and 183 become empty, cassettes 181, 182 can replace them as all cassettes are made removable within the housing. Due to their narrow profile, the cassettes which are in a preheating mode have the capability to heat the food product in a reduced amount of time; i.e., less than 2 hours, compared to the existing prior art systems thus, causing the food product to achieve an acceptable level of temperature before the pouches in a dispensing mode have been entirely emptied. Therefore, the cassettes 180, 183 may be removed, then, be refilled with full pouches and be positioned back into place within the housing in a preheating mode at the place of the former cassettes 181, 182.

In other words, the housing is configured to have operational dispensing locations 100, 103 and preheating locations 101, 102 for receiving removable cassettes to enable the exchange of cassettes from one location to the other depending upon the needs to dispense or preheat the pouches contained into the cassettes. The preheating locations 101, 102 may or may not be directly adjacent the operational dispensing locations 100, 103 for the cassettes. The locations depend upon how the pumping assemblies 13, 14 are configured underneath. Preferably, the operational dispensing locations 100, 103 are provided at both lateral ends of the housing while the preheating locations 101, 102 are grouped in the center of the housing so that sufficient room can be left in the dispensing area 17 between two dispensing tubes 210, 211. The operational dispensing location is preferably a place within the housing where the cassette, and more particularly its outlet opening, becomes, when properly installed, substantially vertically aligned to the pumping assembly. Similarly, a preheating location is preferably a place where the cassette becomes substantially vertically offset when installed with respect to the pumping assembly. However, a preheating location may also be a place vertically corresponding to a pumping assembly placed below where, in that event, the pumping assembly would be mechanically or electrically disconnected and/or in a standing-by position. For example, it could be envisioned to have a number of valves or pumping assemblies equivalent to the number of cassette's locations although this would increase significantly the cost of the device. In a preheating mode, the cassettes may either be in heat-up phase; i.e., below the requested serving temperature, or in a holding phase; i.e., having reached the requested temperature but being hold warm until the dispensing pouch is emptied.

As a preferred mode, the cassettes are removable from the housing simply by sliding motion along a primary direction; e.g., either horizontally or vertically, after the dispensing device has been opened. For instance, in the first embodiment of FIGS. 1 to 4, the front panel of the housing may be mounted to one edge of the housing by hinge means to enable the opening of a front space of the housing and consequently, enabling the cassette to be slidably and horizontally removed from the housing. The cassettes may be guided slidably from their locations in the housing to their removed position by any suitable guiding means. For instance, lower portions of guiding rails or surfaces 80 and upper portions of guiding rails or surfaces 81 may be provided, respectively, in the bottom wall 30 and top wall 31 of the housing to promote an easy and accurate sliding of each cassette in their respective locations; either dispensing or preheating ones. The guiding means are adapted to extend longitudinally within the housing. The guiding means may also serve to arrange gaps 40 between two adjacent cassettes and between the cassettes and the sidewalls 33, 34 of the housing so as to favor an homogeneous temperature regulation within the housing, avoid heat sink from the housing and/or permit eventually hot air to circulate along the sides of the cassettes, when convection heating is a selected mode for heating the cassettes, as it will be explained later in the description. In a possible alternative, the guiding means may be omitted and the cassettes may occupy at best the available space within the housing and may simply be guided by adjacent cassettes and/or sidewalls 33, 34 and/or bottom and top walls 30, 31 of the housing without gaps being left therebetween. Various other guiding means could be used as mechanical equivalents such as T-grooves or dove-tail assembly of the cassette with respect to the housing. The guiding means may also encompass pair(s) of runners attached to the cassettes which are adapted to complementary fit guiding means such as rails of the housing.

Figure 5:
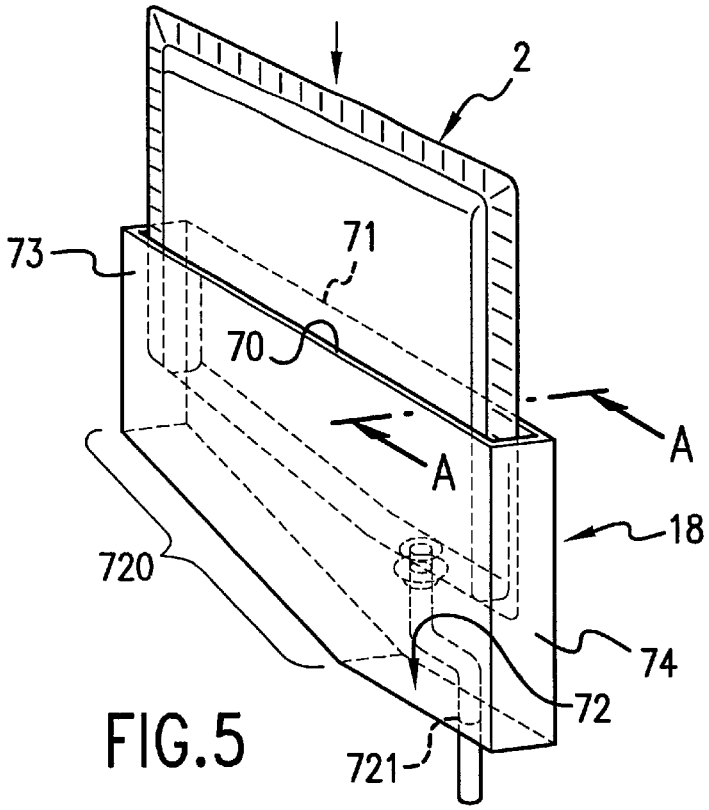
FIG. 5 is a perspective view of a cassette with its food pouch partially inserted therein.
Figure 6:
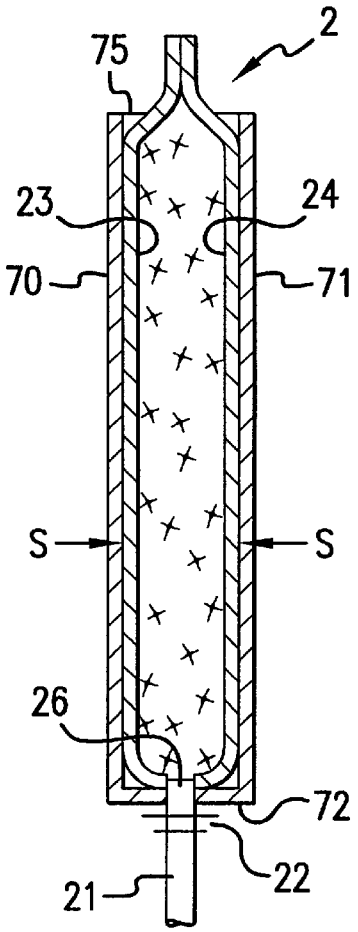
FIG. 6 is a cross-sectional view of a cassette with its pouch along line A—A of FIG. 5.

As illustrated in FIGS. 5 and 6, each individual cassette comprises two extensive primary sidewalls 70, 71 forming thermally conductive surfaces which are adapted to house an elongated, narrowly profiled, food bag or pouch 2 inserted therebetween. More specifically, the sidewalls 70, 71 of the cassette are substantially parallel with a reduced spacing "s" as compared to existing hopper systems. The two sidewalls 70, 71 are thus arranged to receive a narrow profiled food bag or pouch in configuration where the bag or pouch is standing substantially vertically along one of its edge 26 while having a pair of primary extensive side surfaces 23, 24 intimately contacting the inner surfaces of the sidewalls 70, 71. The term "extensive" is used to designate the primary surfaces of the pouch which form the parts of the pouch which ends by relatively narrow sealed or folded edges. The cassette 18 of FIGS. 5 and 6 may also comprise a bottom wall 72 comprising at least a significant portion of slope 720 situated at the rear of an outlet opening 721 forming a passage for the fitment assembly 22 of the pouch. The portion of slope 720 should preferably be inclined with respect to horizontal in the housing of an angle comprised between 5 to 15° so as to promote a better evacuation of the product while keeping a sufficient rear height of pouch which is not detrimental for the overall product capacity of the pouch. A rear wall 73 and a front wall 74 of the cassette are also provided to delimit with the other walls 70 to 72, an upper open cavity 75 for the introduction of the pouch from above of the cassette.

Figure 15:
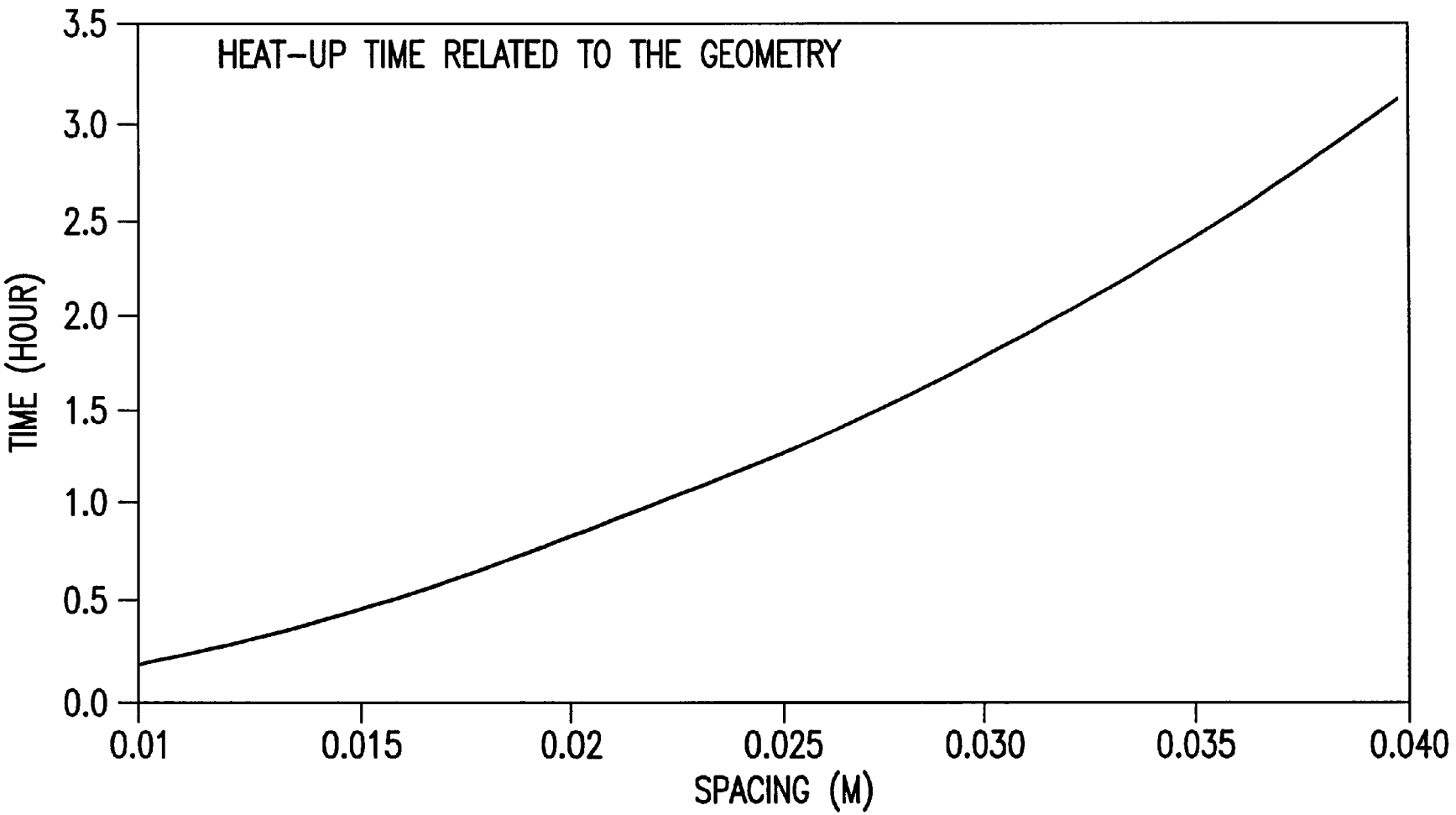
FIG. 15 is a curve illustrating the time; in Y axis, which is necessary for a pouch to become heated to warm as a function of the spacing between a pair of opposed thermal conductive surfaces in X axis.

Experimental tests have shown that the heat-up time was directly influenced by the spacing "s" between the two thermal conductive surfaces in such a configuration almost irrespective of the pouch capacity. FIG. 15 illustrates the heat-up time related to the spacing "s" to heat a pouch of about 3 Kg to reach a temperature of about 70° C. from ambient state. The energy requirement to heat a 3 Kg pouch is of about 400 kJ, thereby necessitating an average heating power of about 300 Watts. The curve has shown to remain substantially the same when varying the capacity of the pouch to respectively 2 Kg and 4 Kg. When the pouch capacity vary, the width of the pouch is kept the same to conform to the available spacing "s" between the two thermal conductive surfaces while the other dimensions of the pouch may vary according to the increase or decrease of capacity. Therefore, the spacing "s" may remain the same, thereby very little influencing the overall heat-up time.

Therefore, the spacing "s", for successfully heating a large size pouch containing food at ambient or refrigerated state, in less than 2 hours, should preferably be of less than 40 mm, even preferably of less than 35 mm, more preferably of about 30 mm. Of course, the heating time may also slightly vary as a function of the intrinsic thermal conductivity of the food product. Foodstuff may have a thermal conductivity that varies from about 0.2 to 1.0 $W.m^{-1}.K^{-1}$. As an example, cheese sauce has a thermal conductivity "k" of about 0.5 $W.m^{-1}.K^{-1}$.

In order to provide a sufficient contact with the pouch, the thermal conductive surfaces of the sidewalls 70, 71 should preferably represent from about 80 to about 98%, preferably of 85 to 95%, of the total internal surface of the cassette available to contact with the pouch. As an example, for accomodating a pouch of from 2.7 to 3.2 Kg, the cassette should have two opposed thermal conductive surfaces of about 900 $cm^2$ each, thereby representing 85% of the total surface of the cassette.

Figure 7:
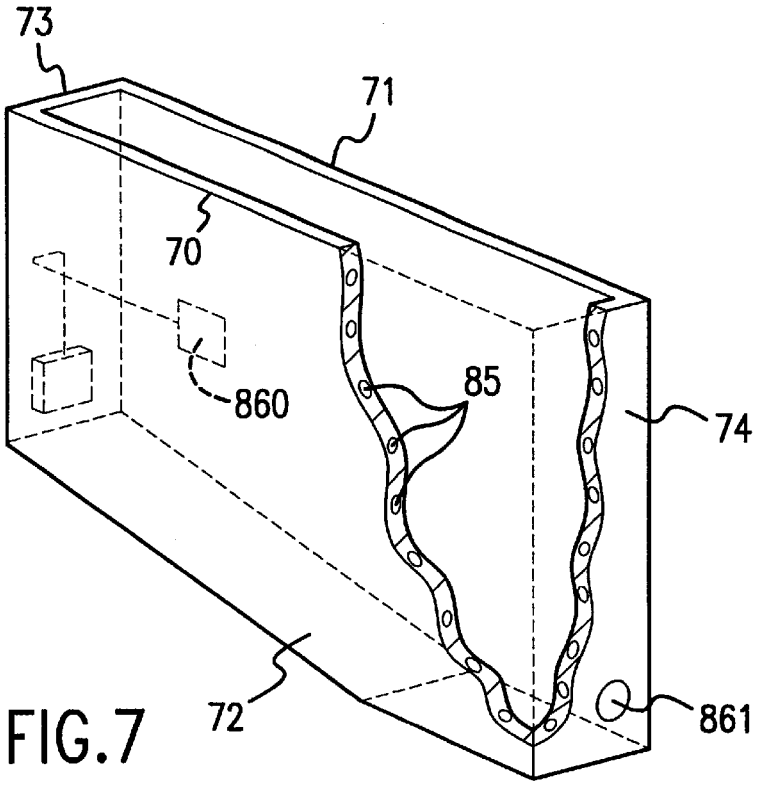
FIG. 7 is a perspective partially sectioned view of a cassette including embedded resistive heating elements.
Figure 8:
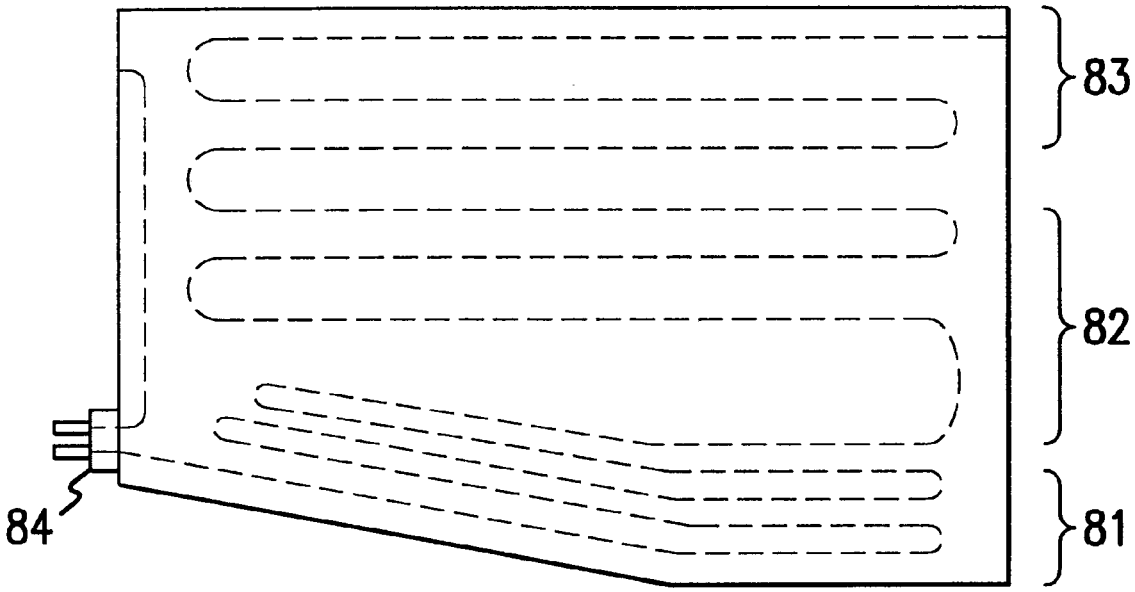
FIG. 8 is a side view of the cassette of FIG. 7.

FIGS. 7 to 8 illustrate a preferred modes for producing heaters from the cassettes. Heating of the cassette is preferably carried out by resistive heating elements 85. The resistive elements may be integrated in the sidewalls 70, 71 and preferably, in all the walls 70 to 74 of the cassette. The walls of the cassette may comprise a solid matrix of any suitable material which can repeatedly withstand temperatures up to about 100° C. during an extensive period of time. As solid matrix, it is meant any sort of homogeneous layer(s) or laminate(s) of supporting material to which are secured resistive element(s). The heating elements may be wire(s), fibers, mat(s), woven or unwoven fabric(s), grid(s), etched foil(s) or any suitable resistive element(s). The elements may be provided to the solid matrix in a variety of shapes such as continuous or discontinuous strand(s), strip(s), tube (s), patch(es), or any other suitable shapes.

Figure 7A:
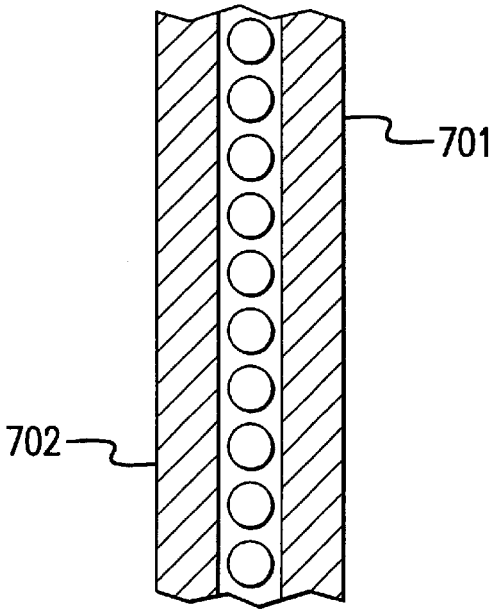
FIG. 7A represents a cross-section along line C—C of FIG. 7 showing a detail of the structure of the cassette.

In a preferred embodiment, the heating resistive elements are electrical resistive wires embedded or sandwiched within a solid material matrix forming the walls 702, 703 as illustrated in FIG. 7A.

The solid matrix may be a highly thermal conductive metal such as aluminum, steel, stainless steel, copper or any other suitable metal including electrically insulated resistive elements. The material matrix for the walls may also be advantageously made of shapeable or moldable materials such heat resistant polymer materials. The polymer material may be selected from the group consisting of polyetherimide, polyimide, PEEK, fluoropolymers, polyphtalamide, polyphenylenesulfide (PPS), polyester, epoxy and combinations thereof. A suitable polyimide material may be Kapton® manufactured and sold by E.I. du Pont de Nemours & Company. The resistive elements should preferably be positioned within the solid matrix at a distance relatively close to the heating surface of the cassette. Preferably, when a polyemer resin is used, the resistive elements should not be distant from the internal heating surfaces of the cassette more than 1.5 mm, preferably 1.0 mm, even more preferably, 0.6 mm so as to keep a good heat transfer toward the pouch.

The resistive elements 85 may be fabricated of nickel-chrome, nickel-chrome-iron, nickel-copper, nickel-iron or any other materials that is commonly known and available that has enough resistance to the flow of electricity to produce substantial heat and high enough melting temperature to withstand heat when electricity is applied therein. In a preferred embodiment, the resistive heating elements are wire wound elements that are created by spiralling fine resistance wires around fiberglass cord. The element is then laid out in a pattern within the solid polymer matrix which can be conformed to the three-dimensional shape to form the cassette. Those elements have proved to have good physical strength and flexibility for the intended application.

In another embodiment, the resistive heating elements are etched foil elements. Those elements are created by acid etching a circuit in metal resistance alloy foil; e.i., nickel alloy foil, and supported by the solid matrix.

Figure 7B:
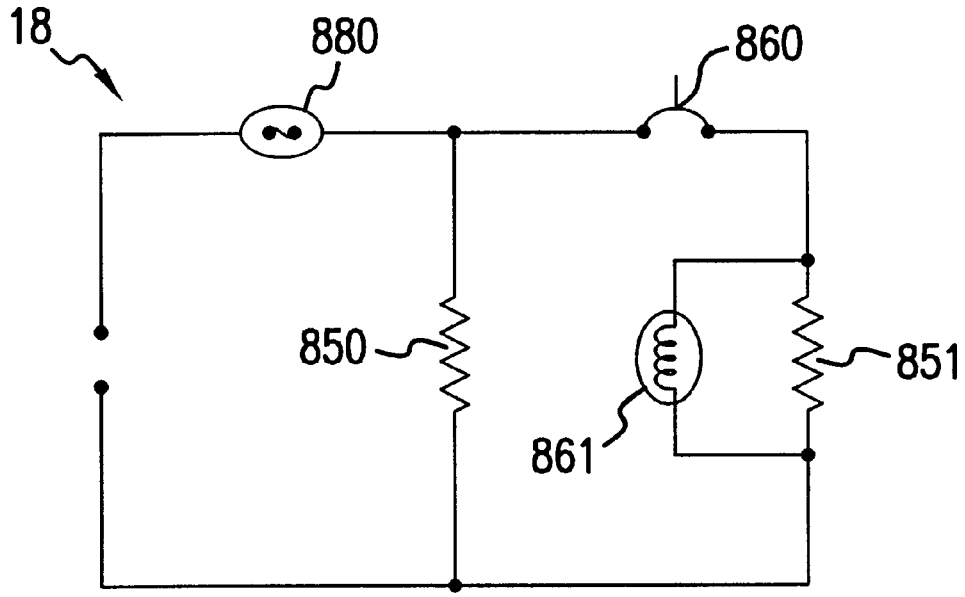
FIG. 7B is a circuit diagram of one embodiment of a two-mode heating cassette of the invention.

In a preferred mode of the invention, each cassette 18 is supplied with heating elements to accomplish a two-mode heating. Two-mode heating refers to the fact in one mode, the cassette is heated at a higher power level and in another mode, the cassette is heated at a comparatively lower power level. As illustrated in FIG. 7B, the cassette may have two sets of resistive elements 850, 851 connected in parallel in the heating resistive circuit. While one set of heating element acts as the primary or maintenance heater 850, the second set would act as a "booster" heater 851. When the unit is switched "on" both the booster and the maintenance heaters are fed in electrical current and run on to rapidly heat the product in a preheating mode, from ambient or refrigerated state to a serve-able temperature. When the product is heated to the serveable temperature, e.g., 50–71° C., the maintenance heater 850 continues to be "on" while the booster heater 851 is switched "off" by opening of the thermostat 860 so as to maintain an elevated holding temperature equal to the servable temperature or slightly lower; e.g. between 50 to 60° C. An indicator light 861 can be coupled to the booster heater to indicate to the operator the cassette is in a heat-up phase with the booster heater "on". A fuse 880 may also be provided to shut the circuit if the current exceeds a certain undesirable level.

Figure 7C:
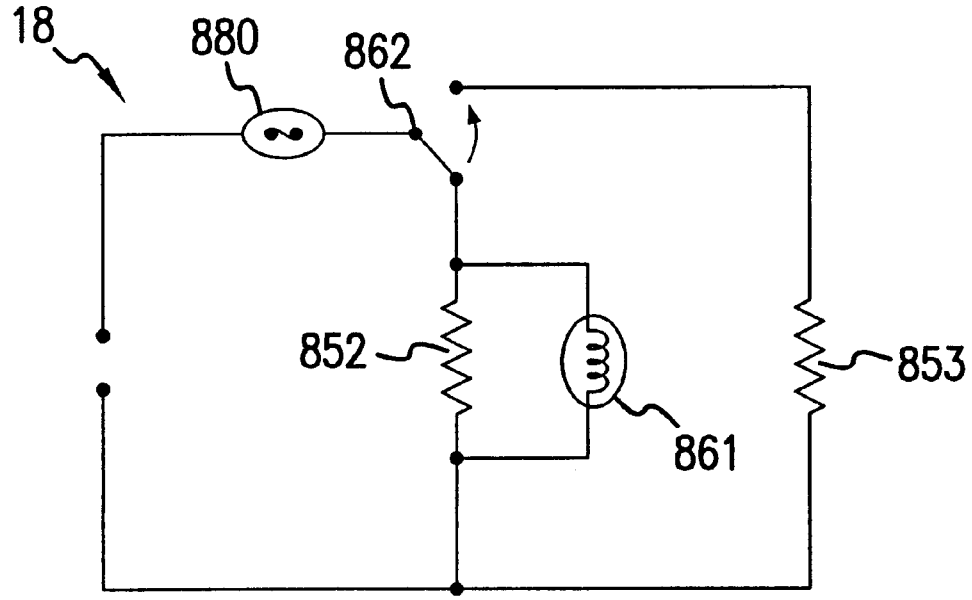
FIG. 7C is a circuit diagram according to a second embodiment of a two-mode heating cassette.

FIG. 7C illustrates another embodiment of the circuitry of the cassette 18 which also accomplishes a two-stage heating. In this embodiment, a first resistive set 852 is also connected in parallel to a second resistive set 853. A two-position thermostat 862 alternatively supplies current to set 852 or set 853 depending upon which mode is desired; i.e., heat-up or holding mode. The resistance of the resistive sets 852 and 853 is selected so that when current passes through first set 852, the heating operates at higher power level and when it passes through second set 853, the heating operates at a comparatively lower power level. A diode or light indicator 861 may be coupled to first set 852 to indicate the higher power set is powered in a heat-up mode.

Controlling of the heat-up mode and holding mode could be controlled by one or more temperature-measuring device, strategically positioned within or on the inside of the cassette. A controlling assembly may be further provided in the dispensing device to receive the temperature measured by the thermostat(s) thereby switching off the booster heater when the measured temperature reaches a predetermined temperature set point corresponding to the serve-able temperature.

The electrical resistive density of the cassette may advantageously be varied as a function of the location along the walls. Variation of the power density may be required to fit specific heating requirements and/or patterns depending upon various factors such as the pouch geometry and dimensions, the type of food, thermal loss and heat rise, etc. As a matter of example illustrated in FIG. 8, it may be advantageous to provide the sidewalls 70, 71, which represent the primary source of heat, with at least three zones of variable heating density; one first lower zone 81 of relatively high power density, a central zone 82 of comparatively lower power density and top zone 83 of comparatively moderate power density. For sake of simplicity, there is illustrated here a single set of resistive elements but it is, of course, intended to have, if necessary, a second set so as to provide a two-mode heating as previously mentioned. For instance, the first zone may be of a power density of from 0.028 Watt per square centimeter, the second zone may have power density of from about 0.025 Watt per $cm^2$ and the third power density may have of from about 0.026 Watt per $cm^2$. As a result, a bag of from 2.5 to 3.5 Kg may be constantly heated at a temperature of about 65° C. (149° F.) with temperature variations of less than 5° C.(10° F.). As illustrated, the power density may be adjusted by various means such as by varying the resistive wire density and/or the cross-section of the resistive wires. As a matter of example, the spacing between two wire strands of a loop may be reduced to increase the wire density (length of wire per unit surface) and consequently increasing the resistance of the zone as the resistance is a function of L/S (L is the length and S is the section of the wire strand). The section of the wire strands may also be varied as the resistance is inversely proportional to the section or width.

It is not an absolute requirement to provide the front, rear and bottom walls with heating elements as they provide relatively smaller surfaces of contact with the pouch. In addition, the pouch does not necessarily need to intimately contact those walls. In particular, the pouch may have sealing portions where no significant portions of food product is retained which may contact the secondary walls 72–74, therefore rendering the heating elements not necessary in these areas. In other words, the total power available for heating the dispensing device being usually restricted by electrical regulations, it is preferred to distribute the heating power onto the primary surfaces of contact of the cassette rather than on the secondary surfaces which do not necessarily well contact the pouch.

In an alternative (not illustrated), the heating resistive elements could be "thick" film elements coupled to the thermal conductive walls. As "thick" film, it is intended film elements which comprise a thick conductive track applied by oxidized metal substrate with a dielectric layer adhered to the metal substrate such as a glaze. A thick film circuit layout is applied by silk-screen printing in which a conductive track constituting the heating element by itself is printed. The technique of manufacturing consists in depositing an ink, consisting of a solvent and a mixture of metal(s) and/or metal oxide(s). The metal(s) and/or metal oxide(s) may be chosen among the group consisting of palladium, copper, nickel, platinum, silver or even carbon may be used. The heat resistive element is terminated by a welded electrical contact portion 84 to make possible the connection to the electrical circuitry of the dispensing device. The contact portion 84 is preferably directly plug-in to an electrical connection in the rear of the housing as a response to the sliding motion of the cassette within the housing. The elevated temperature of serving must usually be adjusted above 140° F. to comply with NSF standards for manual food and beverage dispensing equipments. Usually, the temperature variation will preferably not exceed + or −8° F., even preferably + or −5° F. However, it is advantageous to maintain temperature variations as low as possible in order to prevent formation of hot spots in the food product. The heating and storage configuration of the invention meets this need as more accuracy may be obtained in the temperature control. The temperature may be controlled either by a single thermostat installed in the housing or preferably, individually, by separate thermostats coupled to one side of each cassette.

Figure 9:
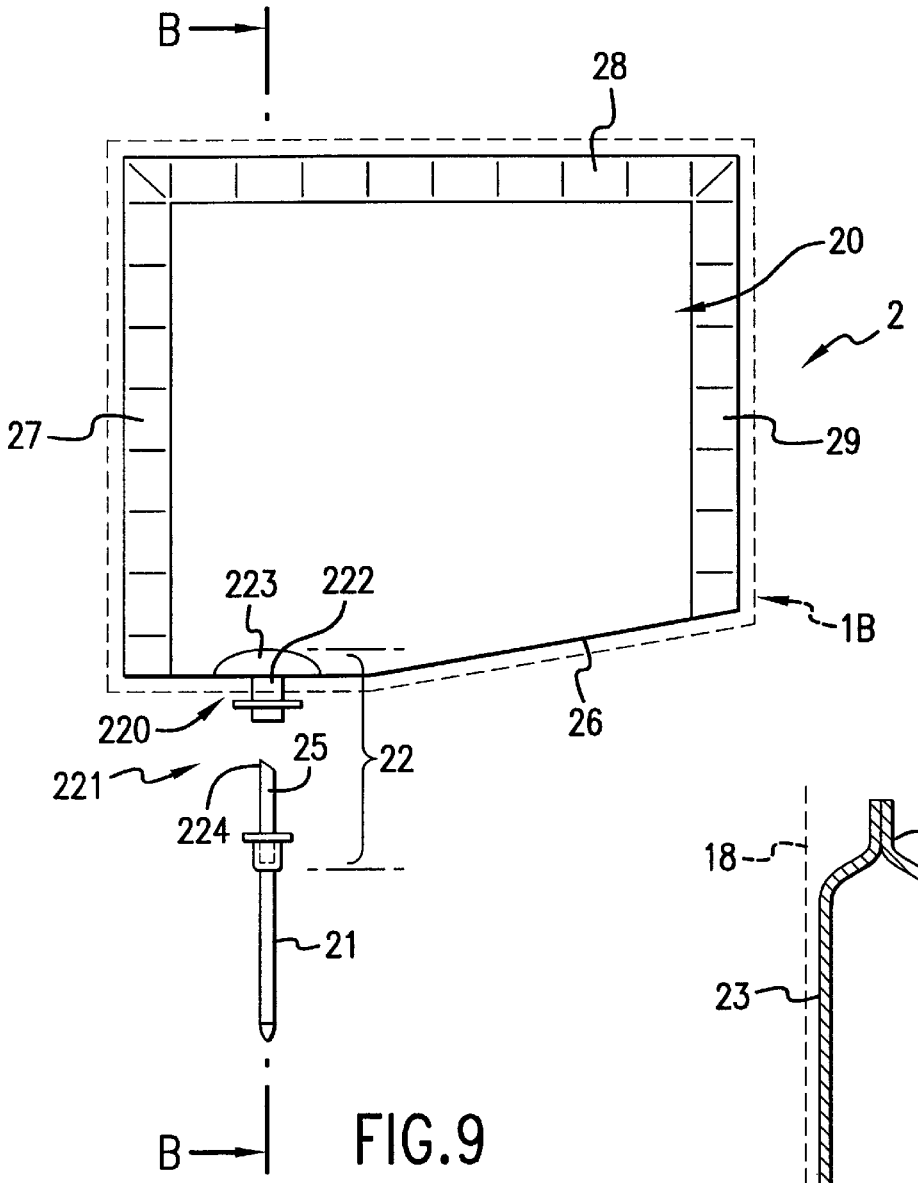
FIG. 9 is a side elevation view of a preferred configuration of pouch or bag according to the present invention with a reference to the cassette in dotted line.
Figure 10:
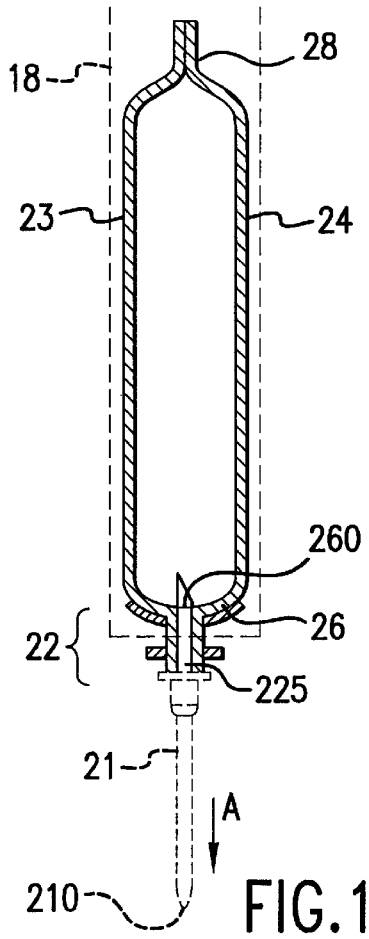
FIG. 10 is a cross sectional view of the pouch of FIG. 9 along lines B—B with the tube part attached to the fitment part.

FIGS. 9 and 10 illustrate a preferred configuration of pouch adapted to be installed in the cassettes. The pouch 2 is made of a suitable flexible plastic such as transparent film. The film may be of a material such as polyethylene, polyamide or PA/EVOH/PA laminate. It is formed fluid-tight, preferably from a double thickness of a section of the film folded up along a lower folded portion or edge 26. The film is sealed along its three other ends to form respectively front, top and rear sealed seams 27, 28, and 29. The four edges 26–29 demarcate together the first extensive side 23 and the second opposed extensive side 24, which are intended to intimately contact the thermal conductive surfaces of the cassette. Such a sealing configuration confers a narrow profiled configuration of pouch or bag. The flexible pouch is made of a suitable size so that it can be positioned in a standing position within the cassette and, when slightly expanding laterally, will conform to the thermally conductive sides of the cassette; i.e., the full part of it keeping an intimate contact, and remain in a standing position without collapsing in the cassette. Means for hanging the pouch in the cassette, such as a stem or similar, may be additionally provided on the top of the cassette but does not appear mandatory as the pouch is intended to stand in the cassette by effect of its own weight and the forces primarily exerted onto the sidewalls 70, 71 of the cassette while the sidewalls of the cassette maintaining a constant maximum thickness of the pouch. Other alternatives are possible (not shown). For instance, the pouch may be formed of a double thickness of a tubular section of the film and sealed along front and rear sealed seams while the top and bottom edges are simply folded up after relative flattening of the tubular section of the film. Importantly, the bottom folded edge or seam 26 may serve to receive the outlet fitment of the pouch. More particularly, the fitment may preferably be sealed in a position across the folded bottom edge of the pouch, thus, reducing the risks of wrinkles and consequently participating to a better evacuation of the food product. Performant evacuation rates may be obtained according to the cassette and pouch configuration as described. As the pouch remains in a standing position within a narrow profiled cassette, the pouch can empty uniformly without formation of bulky local mass. In the area of the fitment, since the product flows in the direction of the fitment and the direction of the film, the film cannot form wrinkles. The narrow spacing between the supportive walls of the cassette also promote the good standing of the pouch thereby minimizing the risks of wrinkles and folds. The evacuation of the pouch can approach 95%, even 98% by weight without need for the operator to manually squeeze the bag.

The fitment assembly 22 is preferably a device for effecting transfer of the food material from the body 20 of the pouch to the area of dispense by piercing the pouch by means of piercing means. More particularly, the fitment assembly comprises a fitment member 220 comprising a portion having a bore 222 and a base end 223 capable of being attached to the pouch. The fitment assembly further comprises a spout member 221 comprising a piercing end 224 and a portion of tube 225 capable of mating in coaxial relationship with the portion of bore of the fitment member so as to form mating surfaces. The device further has a locking assembly adapted to lock the fitment and spout members together in a position whereby the piercing end is in piercing engagement within the pouch. Preferably, the locking assembly is of the type capable of being engaged by the action of pushing the spout fitment within the fitment. The locking assembly may, for instance, be a snap-fitting assembly which comprises at least one raised surface capable of resiliably engaging a recess surface as a response to the axial pushing of the spout member within the assembly. The lower end of the piercing member comprises a gland to which may be connected the dispensing tube 21. In order to avoid immediate spillage of the food product when piercing of the film or membrane of the pouch has been carried out, the distal end of the tube is sealed or crimped. Such a preferred configuration of fitment is precisely described in U.S. patent application Ser. No. 09/698318, the content of which is included here by reference.

The fitment configuration of the pouch allows to maintain the pouch hermetically closed when the pouch is maintained in a preheating mode in its preheating location. As shown in FIG. 9, when the pouch stands in cassette 18 in a preheating mode, the fitment member 220 is at one end sealingly attached to the body 20 of the pouch with the bore 222 being closed by the central portion of film of the pouch. The fitment member 220 may protrude downwardly through the outlet opening 721 of the cassette. In this configuration, it is established a closed, safe and non-contaminated environment within the pouch during all the preheating time. When fluid communication needs to be established, the spout member 221 is pushed within the fitment member 220 which causes the film to be cut away and provides a large opening 260 for allowing the flow of material to pass therethrough as shown by arrow A in FIG. 10. The pouch does not need to be removed from the cassette to establish fluid communication as the fitment member is accessible through outlet opening 721. It can easily be realized how convenient and clean the fluid establishment may be carried out by the foodservice operator. As the preheated pouch needs to replace the dispensing pouch, the operator carries out the following steps of (i) opening the dispensing device, (ii) removing the cassette containing the empty pouch and one cassette containing a preheated pouch, (iii) effecting piercing of the fitment of a preheated pouch contained in the preheated cassette as aforementioned, (iv) then, positioning the cassette with the preheated pouch in the dispensing location, (v) then, engaging of the tube in the valve/pump means, (vi) finally, cutting the crimped end of the tube.

Figure 11:
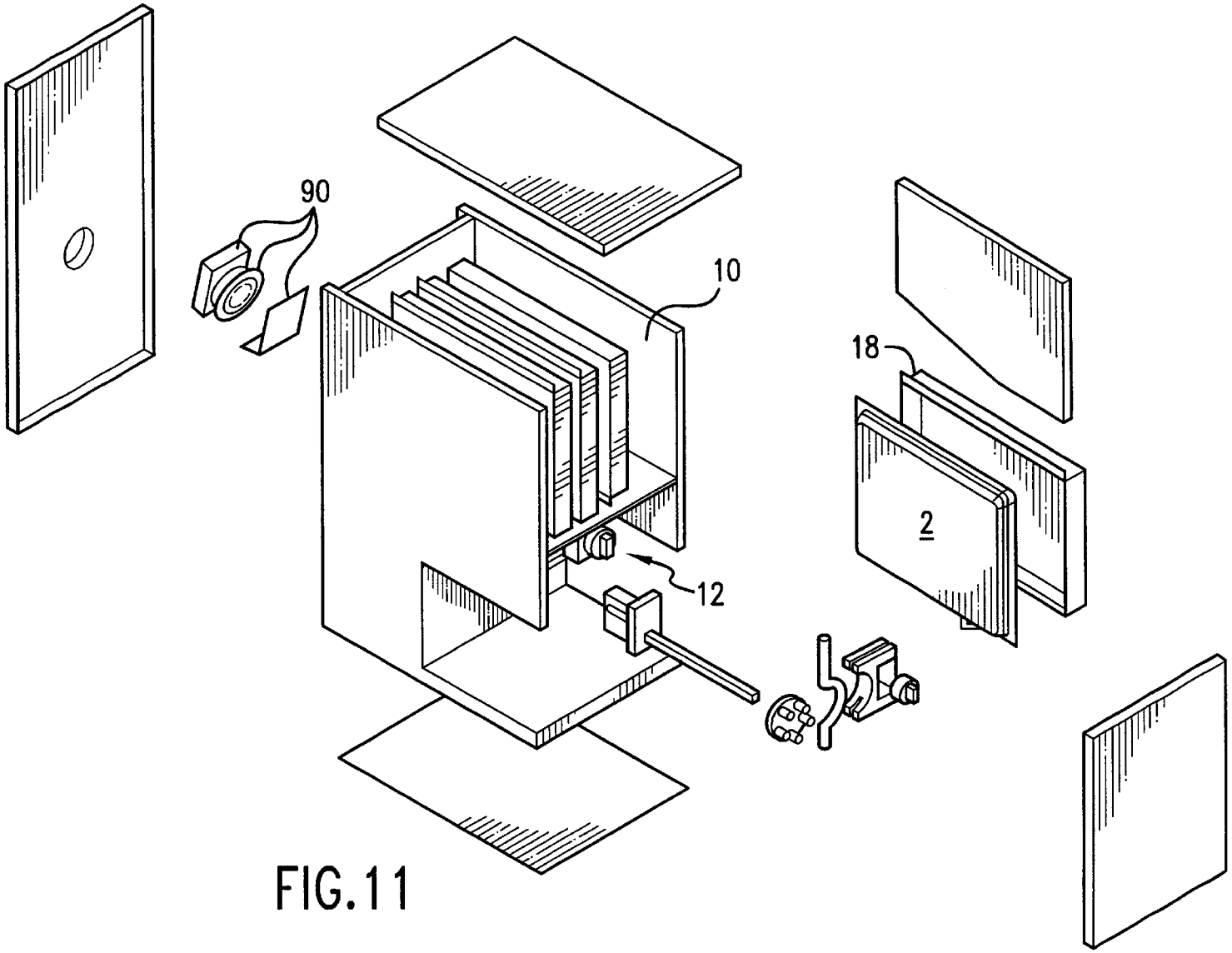
FIG. 11 is an exploded view of a dispensing device according to another embodiment of the present invention.
Figure 13:
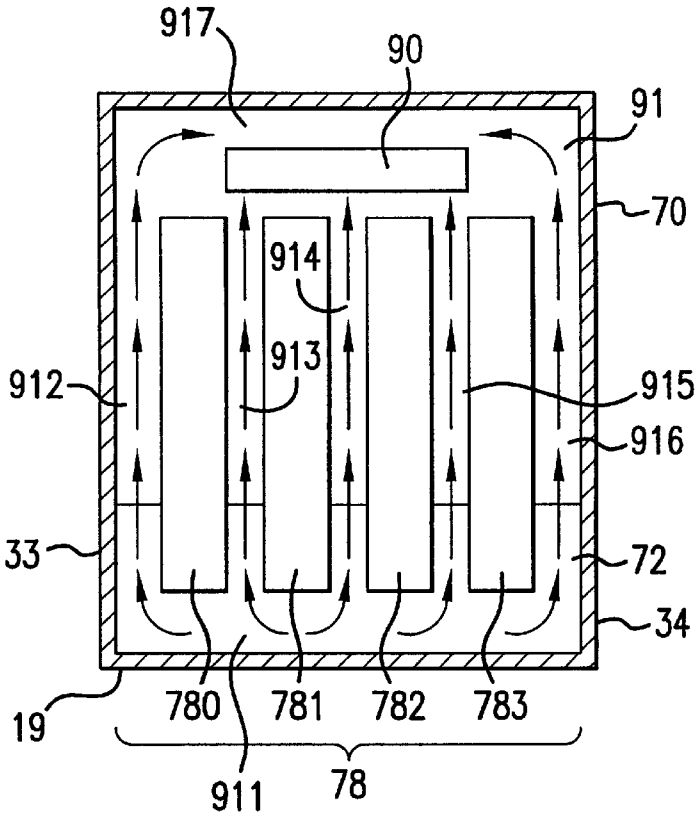
FIG. 13 is a schematic cross sectional view along C—C showing the air flow path of device of FIGS. 11 and 12.
Figure 12:
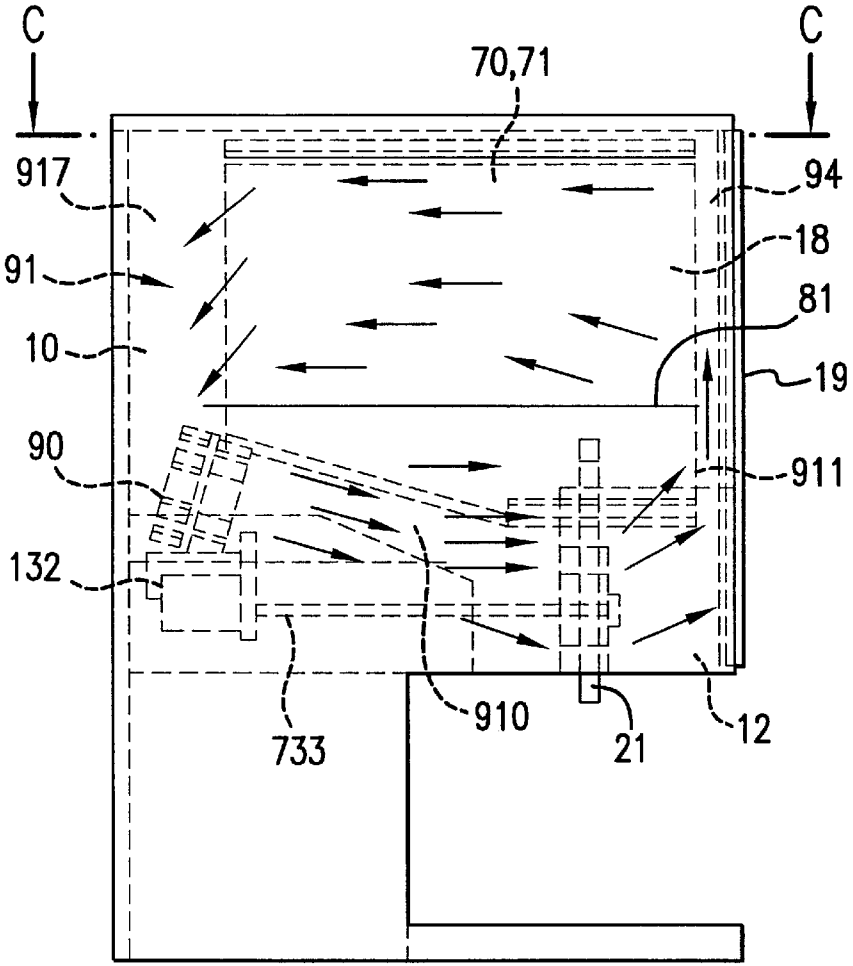
FIG. 12 is a schematic cross sectional view of the air flow path of the dispensing device of FIG. 11.

FIGS. 11 to 13 illustrate a dispensing device of the invention in which the heating assembly for controlling the temperature comprises means for forcing circulation of the temperature controlled air within both the primary housing 10 and the secondary housing 12. More particularly, the forced air circulation means comprises an electrical heater 90 combined with a fan blowing air past the heater, and a flow path distribution 91 for distributing air about the dispensing tube, about the sidewalls of the cassettes and back to the fan/heater. Arrows in FIGS. 12 and 13 help to illustrate the flow path distribution. Starting from the air forcing circulation means 90, the hot air is directed in a substantial horizontal plane in a bottom flow path 910 toward the pumping assemblies which preferably have a plurality of apertures to be traversed by air which distributes within the secondary cavity 12. While circulating from the air circulation means 90 to the pumping means, the bottom walls 72 of the cassettes, and possibly the lower portions of the sidewalls of the cassettes, are heated by the hot air. The bottom walls 72 rests on a preferably thin but rigid thermal conductive support plate or member such as in stainless steel, of the housing 10. After having passed through the pumping assemblies, the hot air goes up in a front flow path 911 along the front panel 19 of the housing. Then, the flow path 911 divides into a series of substantially horizontally oriented return flow paths 912, 913, 914, 915, 916 which distribute along the sidewalls of the cassettes and between the sidewalls of the cassettes and the sidewalls 33, 34 of the primary housing. The division into a series of flow paths as illustrated participates to the increase of the convection surfaces with the cassettes as compared to the existing heating dispensing devices. The division in a variety of flow paths could be performed in the return as illustrated of FIG. 13 and/or in the direction of the flow path 910 when starting from the heater/fan 90. As convection transfer heats the sidewalls of the cassettes, the sidewalls conduct heat to the pouches by conduction transfer due to the intimate contact created between them. Preferably, the walls of the cassettes are made of a thin, rigid and highly thermal conductive material such as stainless steel, copper, aluminum, Incoloy® (Iron-nickel-chromium alloy) or any other suitable metallic material. A return downwardly oriented flow path 917 that extends behind the series of cassettes 18 flows downwardly in direction of the air circulation means 90 to close the loop of the hot air circuit. For sake of clarity FIG. 12 does not show the support walls of the housing which may provide appropriate support to the pumping assemblies and cassettes. Those support walls will be provided and designed so as to confer sufficient rigidity and support for the functional elements of the system while being as thin as possible and significantly apertured to ease heat transfer to the cassettes and/or provide air passages for the flow paths. Similarly, a partition wall 81 is represented in FIG. 12 that shows how the flow paths may be generally divided to circulate in the loop circuit. The partition line preferably horizontally oriented divides the cavity of the housing. Depending upon the location of the line with respect to the cassettes; i.e., its relative height, the division of the flow paths about the cassettes may be obtained only in one way or in the two ways. However, the configuration of such partition may also vary to accomodate various structures and/or shapes and specific contructions and/or mechanical constrainsts.

Figure 14:
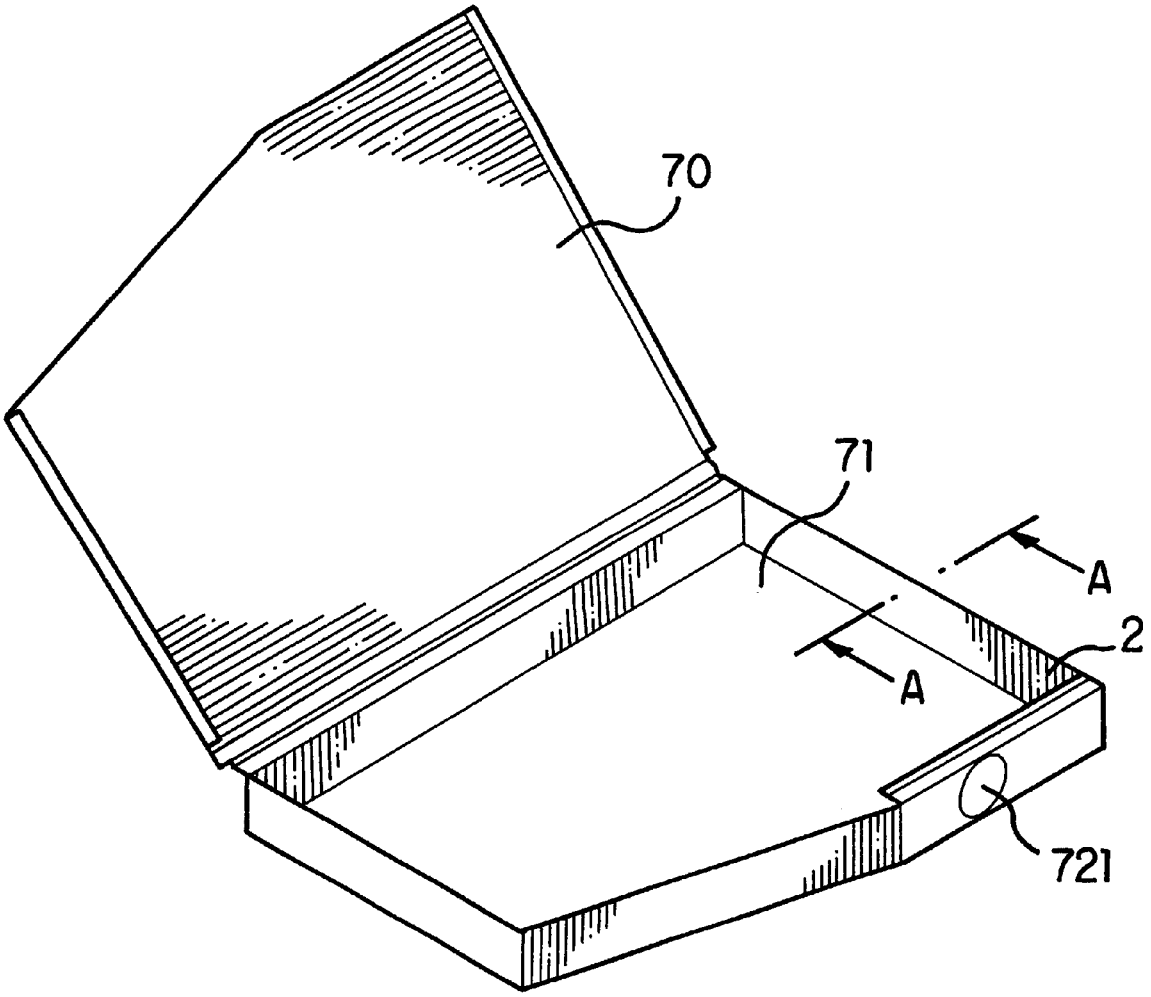
FIG. 14 illustrate a perspective view of another embodiment of the configuration of the cassette.

FIG. 14 illustrates an embodiment of a cassette in which loading of the pouch may be carried out by one of the side of the cassette as opposed to the previous embodiment in which the loading of the cassette was carried out by the top side of the cassettes. The benefit of this embodiment primarily lies in that fact that the loading of the cassette with the pouch may be rendered easier, especially, since intimate contact between the cassette and the pouch may be facilitated by pressing the pouch by the effect of closing the cassette. Therefore, the cassette may include a box-shaped member comprising an openable side 70 while the opposite side 71 of the cassette forms the bottom of the box-shaped member. The pouch may be spread along the bottom side 71 and the upper side 70 is reclosed on the box-shaped member and secured by any suitable closing means. A slight pressure may be applied on the sidewalls 70 when closing which further forces the food product to spread within the pouch and the pouch to more intimately conform to the inside of the cassette. The openable side of the cassette may be coupled along one edge by any suitable hinge means or, alternatively, be a part separable from the rest of the cassette. In this embodiment, the opening 721 for passing the fitment of the pouch may preferably be provided in the bottom wall of the cassette.

While the foregoing description represents the preferred embodiments of the present invention, it will be understood that various additions and/or substitutions may be made therein without departing from the spirit and scope of the present invention. In particular, the preferred embodiment has been described in the context of controlling the temperature of the food product by essentially heating of a food product. The invention could also apply to controlling the temperature by cooling the food product to a desired serving temperature. For example, TEC cooling units using Peltier effect could be utilized to provide a compact conductive transfer to the conductive surfaces. In an alternative, cooling could also be provided by conventional evaporative cooling using a refrigerant in a circuit which is compressed, condensed and evaporated in loop. One skilled in the art will appreciate that the invention may be used with many modifications of structure, forms arrangement, proportions, materials, and components used in the practice of the invention and which are particularly adapted to specific environements and operative requirements, without departing from the principles of the present invention. The presently disclosed embodiments are therefor to be considered in all respects as illustrative and not restrictive.

What is claimed:

1. A food dispensing device having an enhanced capacity for controlling temperature of a flowable food product comprising:

a housing defining an interior cavity;

at least a first pair of opposed thermal conductive surfaces delimiting a spacing therebetween adapted for receiving a first pouch having two extensive walls, said thermal conductive surfaces being substantially oriented within the housing and spaced sufficiently closely to each other for maintaining the pouch substantially in a standing position, with the thermal conductive surfaces being arranged to intimately contact said extensive walls of the pouch;

means for directly heating or cooling said first pair of opposed thermal conductive surfaces for transferring heat with the extensive walls of the pouch by contact therewith; and means for connecting the first pouch for selectively delivering portions of food from the first pouch.

2. A dispensing device according to claim 1, further comprising at least a second pair of opposed thermal conductive surfaces delimiting a spacing therebetween adapted for receiving a second pouch having two extensive walls; said thermal conductive surfaces being substantially oriented within the housing and spaced sufficiently closely to each other for maintaining the second pouch substantially in a standing position, the second pair of thermal conductive surfaces being arranged to intimately contact said walls of the second pouch.

3. A dispensing device according to claim 2, wherein the spacing between the two opposed thermal conductive surfaces of the first and second pairs is equal to or less than 40 millimeters.

4. A dispensing device according to claim 3, wherein the spacing between the two opposed thermal conductive surfaces of the first and second pairs is of about 35 millimeters or less.

5. A food dispensing device having an enhanced capacity for controlling temperature of a flowable food product, comprising:

a housing defining an interior cavity;

at least first and second pairs of opposed thermal conductive surfaces, each pair of thermal conductive surfaces delimiting a spacing therebetween dimensioned for receiving first and second pouches, respectively, each pair having two extensive walls, said thermal conductive surfaces being substantially oriented within the housing so that the respective pouch substantially remains in a standing position, with the thermal conductive surfaces being arranged to intimately contact said extensive walls of the respective pouch;

means for controlling the temperature of said first pair of opposed thermal conductive surfaces; and means for connecting to the first pouch for selectively delivering portions of food from the first pouch;

wherein said second pair of thermal conductive surfaces is maintained in a non-dispensing mode.

6. A dispensing device according to claim 2, wherein said first and second pairs of opposed thermal conductive cavities form respectively part a first and second cassettes that are removable from the housing and are further interchangeable within the cavity.

7. A dispensing device according to claim 6, wherein the cassettes are arranged to be removed by sliding motion of the cassettes from the housing in a primary direction after opening of the housing.

8. A dispensing device according to claim 6, wherein said first cassette is arranged in a location where the cassette is capable of being operatively connected to said valve means to be in a dispensing mode and a second cassette which is arranged in location where the cassette is disconnected from the valve means in a preheating mode.

9. A dispensing device according to claim 6, wherein the first and second cassettes are disposed substantially in parallel in the housing.

10. A food dispensing device having an enhanced capacity for controlling temperature of a flowable food product, comprising:

a housing defining an interior cavity;

at least a first pair of opposed thermal conductive surfaces delimiting a spacing therebetween adapted for receiving a first pouch having two extensive walls, said thermal conductive surfaces being substantially oriented within the housing so that the pouch substantially remains in a standing position, with the thermal conductive surfaces being arranged to intimately contact said extensive walls of the pouch;

resistive heating elements of said opposed thermal conductive surfaces for controlling the temperature of said first pair of opposed thermal conductive surfaces; and means adapted to operatively connect to the first pouch for selectively delivering portions of food from the first pouch.

11. A dispensing device according to claim 10, wherein said heating elements are thick film elements or embedded resistive elements in a solid material matrix.

12. A dispensing device according to claim 10, wherein the thermal conductive surfaces comprise at least a first and second resistive heating sets which are capable of being selectively operated to provide at least two different power modes.

13. A food dispensing device having an enhanced capacity for controlling temperature of a flowable food product, comprising:

a housing defining an interior cavity;

at least a first pair of opposed thermal conductive surfaces delimiting a spacing therebetween adapted for receiving a first pouch having two extensive walls, said thermal conductive surfaces being substantially oriented within the housing so that the pouch substantially remains in a standing position, with the thermal conductive surfaces being arranged to intimately contact said extensive walls of the pouch;

cooling means for cooling said first pair of opposed thermal conductive surfaces; and means adapted to operatively connect to the first pouch for selectively delivering portions of food from the first pouch.

14. A food dispensing device having an enhanced capacity for controlling temperature of a flowable food product, comprising:

a housing defining an interior cavity;

at least a first pair of opposed thermal conductive surfaces delimiting a spacing therebetween adapted for receiving a first pouch having two extensive walls, said thermal conductive surfaces being substantially oriented within the housing so that the pouch substantially remains in a standing position, with the thermal conductive surfaces being arranged to intimately contact said extensive walls of the pouch;

air forced convection means for controlling the temperature of said first pair of opposed thermal conductive surfaces; and means adapted to operatively connect to the first pouch for selectively delivering portions of food from the first pouch.

15. A dispensing device according to claim 14, wherein the air forced convection means comprises a series of flow paths distributing temperature controlled air along the thermal conductive surfaces.

16. A dispensing device for rapidly and efficiently controlling a flowable food product, comprising at least a pair of removable cassettes configured for receiving a pouch that comprises two opposed sidewalls containing at least about 2 Kg of food; the cassettes comprising pairs of opposed thermal conductive surfaces wherein the surfaces delimit together a spacing adapted to contact a pouch and means for controlling temperature of said pair of cassettes, wherein the spacing between the two opposed thermal conductive surfaces of the first and second pairs is at most about 40 mm such that the opposed surfaces retain the pouch in a standing position for directly transferring heat between the opposed surfaces and the sidewalls of the pouch.

17. A dispensing device for dispensing flowable food product comprising:

a housing defining an interior cavity;

at least one pair of removable identical cassettes within the housing; each being adapted for receiving a pouch containing food; said cassettes comprising pairs of opposed thermal conductive surfaces wherein the surfaces delimit together a spacing adapted to receive a pouch;

means for controlling temperature of said at least pair of cassettes; wherein the cassettes are interchangeable.

18. A method for rapidly and uniformly controlling temperature and delivering a flowable food comprising:

providing a narrow profiled pouch comprising two extensive walls connected together by a plurality of peripheral edge portions to form a closed interior for the food of relatively low width; and a fitment to deliver the flow of food through an outlet; said fitment being sealed across one edge portion of the pouch;

positioning said narrow profiled pouch between two opposed vertically oriented thermal conductive surfaces delimiting a spacing therebetween adapted for receiving the pouch with the extensive walls intimately contacting the thermal conductive surfaces;

directly heating or cooling the thermal conductive surfaces for heating or cooling the extensive walls of the pouch by conduction transfer;

providing valve means to selectively control the flow of food from the pouch.

19. A method for ensuring a steady supplying in warm food product within a dispensing device comprising:

providing a pair of cassettes containing food within a container; said cassettes being interchangeable within the dispensing device;

providing heat to each of said cassettes to warm the food product; and dispensing food from one of said heated cassette while holding the other cassette warm.

20. The method of claim 18, wherein the peripheral edge portions comprise sealed peripheral edge portions, and the positioning of the pouch comprises positioning the sealed edge portions between and spaced from the opposed surfaces.

21. A dispensing device having an enhanced capacity for controlling the temperature of a flowable food product, comprising:

a housing defining an interior cavity;

a bottom support surface within the housing; and a first pair of directly heated contact surfaces spaced from each other sufficiently closely for maintaining the pouch substantially in a standing position on the bottom support surface, with the contact surfaces being arranged to intimately contact said extensive walls of the pouch;

a heater associated with the first pair of opposed contact surfaces for directly heating the contact surfaces such that the heat is transferred to the pouch through the contact surfaces by the intimate contact of the contact surfaces with the extensive walls of the pouch; and a pump associable with the first pouch for selectively delivering portions of food from the pouch.

22. The dispensing device of claim 21, further comprising a first cassette that is removably receivable in the interior cavity and that comprises the first pair of contact surfaces and bottom support surface.

23. The dispensing device of claim 22, wherein the cassette has an internal surface that comprises the contact surfaces, the contact surfaces have an area of between about 80% and about 98% of the internal surface.

24. The dispensing device of claim 22, wherein the heated contact surfaces are spaced from each other by at most about 40 mm.

25. The dispensing device of claim 24, wherein the heated contact surfaces are spaced from each other by at most about 35 mm.

26. The dispensing device of claim 22, wherein the pump comprises a peristaltic pump.

* * * * *